US009934955B2

(12) United States Patent
Yasuda

(10) Patent No.: US 9,934,955 B2
(45) Date of Patent: Apr. 3, 2018

(54) INCANDESCENT LAMP

(71) Applicant: Stanley Electric Co., Ltd., Tokyo (JP)

(72) Inventor: Satoshi Yasuda, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/426,384

(22) Filed: Feb. 7, 2017

(65) Prior Publication Data

US 2017/0250067 A1 Aug. 31, 2017

(30) Foreign Application Priority Data

Feb. 29, 2016 (JP) ..... 2016-037200

(51) Int. Cl.

| | |
|---|---|
| ***H01K 1/40*** | (2006.01) |
| ***H01K 1/28*** | (2006.01) |
| ***H01K 1/38*** | (2006.01) |
| *F21S 8/10* | (2006.01) |

(52) U.S. Cl.

CPC ..... *H01K 1/40* (2013.01); *H01K 1/28* (2013.01); *H01K 1/38* (2013.01); *F21S 48/1168* (2013.01); *F21S 48/214* (2013.01)

(58) Field of Classification Search

CPC .... H01K 1/40; H01K 1/28; H01K 1/38; F21S 48/214; F21S 48/1168

See application file for complete search history.

(56) References Cited

U.S. PATENT DOCUMENTS

2015/0279653 A1* 10/2015 Kanagawa ..... H01K 1/38 313/580

FOREIGN PATENT DOCUMENTS

| | | |
|---|---|---|
| JP | 2015-185419 A | 10/2015 |
| JP | 2015-185449 A | 10/2015 |

* cited by examiner

*Primary Examiner* — Donald Raleigh
*Assistant Examiner* — Kevin Quarterman
(74) *Attorney, Agent, or Firm* — Kenealy Vaidya LLP

(57) ABSTRACT

An incandescent lamp is provided which prevents disconnection of a coupling part between a filament and a lead wire and also which improves impact resistance. A lead wire 4 has, in a standing portion 11 inside of a bulb 2, a first zone 19*a* to a third zone 19*c* in order from a top. The third zone 19*c* further penetrates through a pinch seal part 3 while firmly fixed thereto. The first zone 19*a* and the second zone 19*b* are formed of materials consisting primarily of molybdenum and nickel, respectively. The third zone 19*c* is formed of a Dumet wire 29.

4 Claims, 2 Drawing Sheets

INCANDESCENT LAMP

BACKGROUND OF THE INVENTION

Field of the Invention

The present invention relates to an incandescent lamp loaded in, for example, an automobile.

Description of the Related Art

An incandescent lamp is known, as an automobile headlight, which includes: a bulb made of soft glass; a sealing part made of soft glass sealing the bulb; a pair of lead wires which has, in the bulb, standing portions standing from the sealing part in a manner such as to face each other and which penetrates through the sealing part while being firmly fixed thereto to be exposed to an outside of the sealing part; a filament which is arranged between the standing portions of the pair of lead wires and which has both end parts held at tip parts of the respective standing portions; and a bridge made of soft glass which is arranged between the standing portions of the pair of lead wires on a side located closer to the sealing part than the filament and which has both end parts coupled to the respective standing portions.

A Dumet wire is typically used as the lead wire. The Dumet wire has a structure such that a core part formed of an alloy of iron and nickel is coated with copper, and has a close thermal expansion rate to thermal expansion rates of the sealing part and the bridge made of soft glass. Therefore, it is possible to improve sealing performance of a part of the sealing part through which the Dumet wire is penetrating and coupling performance of a part of the bridge through which the Dumet wire is penetrating after the sealing part and the bridge through which the Dumet wire is penetrating are melted, cooled, and solidified at time of production of the incandescent lamp.

The filament is held at tips of the lead wires with the tips being bent downward. A temperature of the filament turns high when the incandescent lamp is turned ON, and as result of repeatedly turning ON and OFF the incandescent lamp, holding parts of the lead wires holding the filament gradually open while subjected to gradual embrittlement and the filament falls off the holding parts, thereby facilitating disconnection of the holding parts.

Japanese Patent Application Laid-open No. 2015-185419 and Japanese Patent Application Laid-open No. 2015-185449 disclose incandescent lamps which address the aforementioned problem. With the incandescent lamps, a lead wire is divided into a filament-side portion and an electrode-side portion, and the electrode-side portion is of a Dumet wire but the filament-side portion is of a wire material, in place of the Dumet wire, which consists primarily of molybdenum with a high melting point.

The incandescent lamp 1 disclosed in Japanese Patent Application Laid-open No. 2015-185449 has the filament-side wire material further formed to be thinner than the electrode-side Dumet wire, so that upon welding coupling between end parts of the wire material consisting primarily of molybdenum and the Dumet wire, the end part of the Dumet wire melts and is coupled to the end part of the wire material consisting primarily of molybdenum in a manner such as to surround the end part of the wire material, thereby improving of the coupling strength between the both.

Incandescent lamps loaded in, for example, automobiles are subject to vibration and impact. The opening of the holding parts of the lead wires holding the filament facilitates separation of the filament and the lead wires from each other when the incandescent lamp is subjected to vibration or impact, facilitating the disconnection. Therefore, there arises a strong demand on the incandescent lamp for reinforced vibration resistance and impact resistance.

SUMMARY OF THE INVENTION

It is an object of the present invention to provide an incandescent lamp which achieves further disconnection prevention with reinforced vibration resistance and impact resistance.

An incandescent lamp according to one aspect of the invention includes: a bulb being made of soft glass; a sealing part being made of soft glass and sealing the bulb; a pair of lead wires which has standing portions standing in the bulb from the sealing part in a manner such as to face each other and which penetrates through the sealing part while being firmly fixed to the sealing part to be exposed to an outside of the sealing part; a filament which is arranged between the standing portions of the pair of lead wires and which has both end parts held at tip parts of the respective standing portions; and a bridge which is made of soft glass and arranged between the standing portions of the pair of lead wires on a side closer to the sealing part than the filament and which has both end parts coupled to the respective standing portions. Each of the lead wires is divided into a first zone, a second zone, and a third zone whose Young's moduli decrease in order from a one end side to an another end side where the one end is an end of the lead wire on a tip side of the standing portion and the another end is an end of the lead wire on an exposure side exposed to the outside of the sealing part. The third zone is formed of a Dumet wire or a nickel plating film-fitted Dumet wire. Each lead wire penetrates through the sealing part in the third zone.

With one aspect of the invention, the first zone and the second zone, which have the higher Young's moduli than the Dumet wire or the nickel plating film-fitted Dumet wire of the third zone, occupy the standing portion. As a result, stiffness of the standing portion increases, thus reinforcing vibration resistance and impact resistance of the incandescent lamp, which permits further prevention of holding part disconnection.

Preferably, the first zone is formed of a material consisting primarily of molybdenum.

With the aforementioned configuration, the pair of lead wires holds the filament in the first zone consisting primarily of molybdenum, that is, the first zone is substantially formed of a non-alloy, single material with a high melting point, which makes it possible to suppress embrittlement of a holding part of the lead wire holding the filament and suppress the disconnection.

Preferably, the second zone is formed of a material consisting primarily of nickel, and each lead wire penetrates through the bridge in the second zone.

With the aforementioned configuration, the second zone consisting primarily of nickel, which has a smaller difference in thermal expansion ratio from the bridge made of soft glass than molybdenum, penetrates through the bridge. As a result, lack of a bridge portion through which the lead wire penetrates is suppressed.

Preferably, the second zone is subjected to crushing in a radial direction at a part thereof penetrating through the bridge.

With the aforementioned configuration, a surface area of the part of the second zone penetrating through the bridge increases. As a result, after melting and cooling of the bridge upon production, adhesion to the bridge improves, a degree of coupling between the bridge and the second zone increases, thereby improving the vibration resistance and the impact resistance of the incandescent lamp.

DESCRIPTION OF THE PREFERRED EMBODIMENTS

Figure 1:
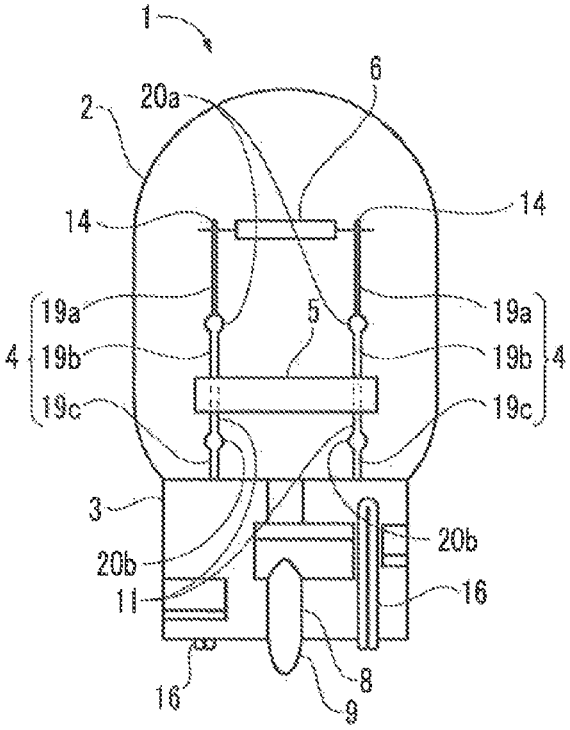
FIG. 1 is a side view of an incandescent lamp.

FIG. 1 is a side view of an incandescent lamp 1. The incandescent lamp 1 is provided as, for example, an automobile headlight at the front of the automobile.

The incandescent lamp 1 includes a bulb 2, a pinch seal part 3, a pair of lead wires 4, a bridge 5, a filament 6, and an exhaust pipe 8. The bulb 2, the pinch seal part 3, the bridge 5, and the exhaust pipe 8 are formed of soft glass for the purpose of melting point reduction. In the present embodiment, the same glass material is used as the soft glass of the bulb 2, the pinch seal part 3, the bridge 5, and the exhaust pipe 8, which are all colorless and transparent. However, it is possible to appropriately adopt, for example, umber other than a solid color as a color of the bulb 2.

The exhaust pipe 8 is arranged on a side surface of the pinch seal part 3. While not yet subjected to pinch sealing processing in production processes of the incandescent lamp 1, the pinch seal part 3 is formed into a cylindrical shape which permits insertion of an assembly, to be described later on and illustrated in FIG. 2, in the bulb 2 through an inner side space of the pinch seal part 3. The exhaust pipe 8 is formed on the side surface of the pinch seal part 3, and communicates an inside and an outside of the bulb 2 with each other before sealing processing of the bulb 2. A closing part 9 forms an end part of the exhaust pipe 8, and is not formed at start of production of the incandescent lamp 1 but formed along with closing processing of the exhaust pipe 8 performed at time of the production of the incandescent lamp 1.

Figure 2:
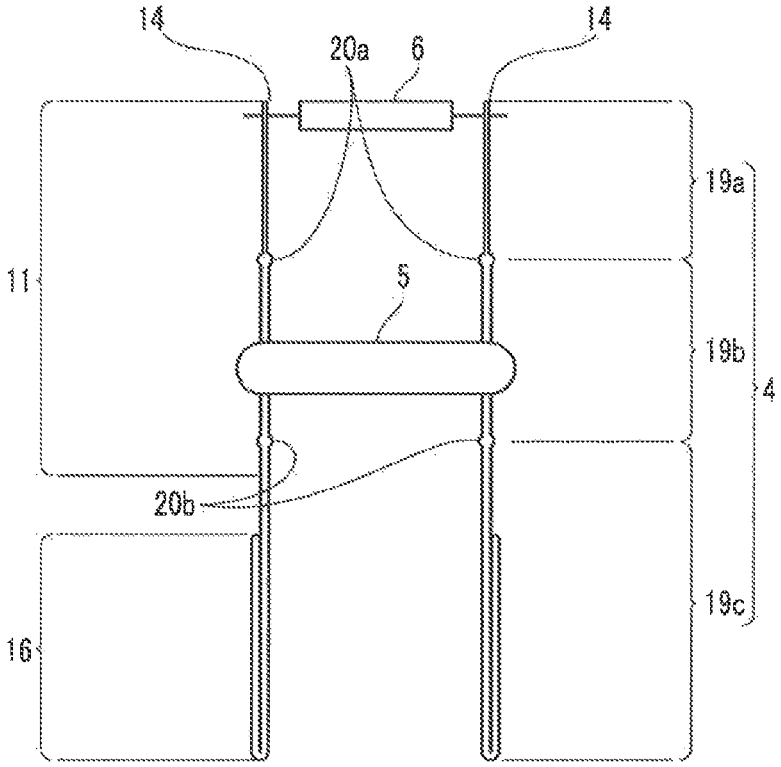
FIG. 2 is a side view of an assembly before inserted in a bulb.

FIG. 2 is a side view of the assembly before inserted in the bulb 2. FIG. 2 clarifies a range between both ends of each portion in the lead wires 4. In FIGS. 1 and 2, the pair of the lead wires 4 has standing portions 11 which face each other in the bulb 2 and which stand from the pinch seal part 3. Hereinafter, for description convenience, a direction in which the standing portions 11 of the pair of the lead wires 4 face each other is defined as a "facing direction" (a horizontal direction in FIGS. 1 and 2) and a direction in which the standing portions 11 stand is defined as a "standing direction" (a vertical direction in FIGS. 1 and 2).

The bridge 5 is arranged between the standing portions 11 of the pair of the lead wires 4 at height located at substantial middle points between an upper end of the pinch seal part 3 and coupling sections 20*a*, and also has both end parts in the facing direction coupled to the both standing portions 11. The aforementioned coupling is achieved in the production processes of the incandescent lamp 1 by inserting the standing portions 11 of the pair of lead wires 4 into an inner circumference side of the bridge 5, which has initially been annular, and then melting and pinching the bridge 5 made of soft glass, resulting in coupling performed through welding.

The filament 6 is arranged on a side closer in the standing direction to upper end sides of the standing portions 11 than the bridge 5, extends in the facing direction, and has both end parts held by tip parts 14 of the respective standing portions 11. There are various modes of holding the filament 6 by the lead wires 4. For example, there is a mode of holding the filament 6 at the lead wires 4 by winding the end parts of the filament 6 around the tip parts 14 of the lead wires 4. In addition, there is a holding mode of bending the tip parts 14 of the standing portions 11 to the end parts of the filament 6.

Each lead wire 4 penetrates through the pinch seal part 3 while firmly fixed thereto. As a result, one end of the lead wire 4 as an end located on a tip part 14 side of the standing portion 11 is located in the bulb 2 and another end of the lead wire is exposed to an outside of the incandescent lamp 1 located outside of the bulb 2.

Each lead wire 4 is formed into a double-lined part which is bent at a predetermined point of an exposed portion located on a side of the aforementioned another end, forming an electrode terminal 16. Each electrode terminal 16 makes contact with a power feed terminal of a socket, not illustrated, when the pinch seal part 3 is fitted to the socket. The double-lined part of the electrode terminal 16 contributes to an increase in an area of the connect made between the power feed terminal of the socket and the electrode terminal 16.

Based on a difference in a kind of wire materials, the lead wire 4 is divided into three zones: a first zone 19*a*, a second zone 19*b*, and a third zone 19*c* in order from a one end side to an another end side. The coupling section 20*a* is a section which is located at the standing portion 11 above the bridge 5 and which couples together the first zone 19*a* and the second zone 19*b* through welding. A coupling section 20*b* is a section which is located at the standing portion 11 above a top surface of the pinch seal part 3 and below the bridge 5 and which couples together the second zone 19*b* and the third zone 19*c* through welding.

The pinch seal part 3 is melted, then pinched with a predetermined pinching tool, then cooled and solidified to form a sealing part in the production processes of the incandescent lamp 1. A pinching direction is a direction orthogonal to both the facing direction and the standing direction, i.e., a "thickness direction" of the solidified pinch seal part 3. After the solidification, the pinch seal part 3 is formed into a shape which is long in the facing direction of the standing portion 11 of the lead wires 4 and which is thin in the thickness direction.

The tip part 14 in the lead wire 4 belongs to the first zone 19*a* and the electrode terminal 16 in the lead wire 4 belongs to the third zone 19*c*. The entire first zone 19*a* and second zone 19*b* belong to the standing portion 11. Only a range of the third zone 19*c* between the coupling section 20*b* and the pinch seal part 3 belongs to the standing portion 11.

The second zone 19*b* and the third zone 19*c* have the same diameter (have the same cross-sectional diameter). The first zone 19*a* is formed to be thinner than the second zone 19*b*. Expressing diameter relationship by formula provides: a diameter of the first zone 19*a*<the diameter of the second zone 19*b*=the diameter of the third zone 19*c*.

The first zone 19*a* is formed of a material consisting primarily of molybdenum. That is, the first zone 19*a* is substantially formed of molybdenum as a single material. The second zone 19*b* is formed of a material consisting primarily of nickel. That is, the second zone 19*b* is substantially formed of nickel as a single material.

Figure 3:
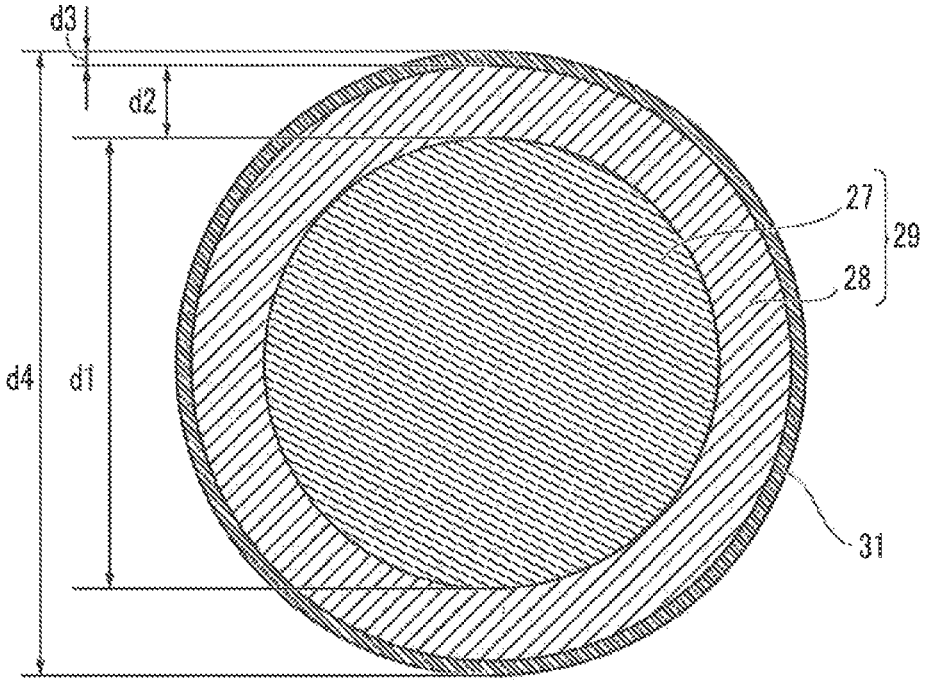
FIG. 3 is a cross-sectional view of a plating film-fitted Dumet wire.

FIG. 3 is a cross-sectional view of a plating film-fitted Dumet wire 26. The plating film-fitted Dumet wire 26 has a Dumet wire 29, and a plating film 31 formed through nickel plating processing of a surface of the Dumet wire 29. The Dumet wire 29 itself has a well-known structure formed of: a core part 27 of an alloy of iron and nickel; and a surrounding part 28 which consists primarily of copper and which coats the core part 27.

The third zone 19*c* may be either the plating film-fitted Dumet wire 26 having the plating film 31 or a wire material provided with only the Dumet wire 29 obtained by removing the plating film 31 from the plating film-fitted Dumet wire 26. It is assumed that the wire material provided without the plating film 31 but with only the Dumet wire 29 is adopted for the third zone 19*c* in the embodiment of FIGS. 1 and 2.

In FIG. 3, d1 denotes a diameter of the core part 27, d2 denote a thickness of the surrounding part 28, d3 denotes a thickness of the plating film 31, and d4 denotes a diameter of the plating film-fitted Dumet wire 26. One example of values of d1 to d4 is shown in units of mm: d1≈0.387, d2≈0.055, d3≈0.0015, and d4=0.5, where the value of d4 is a set value and the values of d1 to d3 are measured values.

In a case where the Dumet wire 29 without the plating film 31 is adopted as the third zone 19*c* as is the case with the embodiment of FIGS. 1 and 2, the diameter of the third zone 19*c* decreases to be smaller than 0.5 mm by 2×d3, but d1 and d2 increase, so that the Dumet wire 29 having a set value at d1+2×d2=0.5 mm is provided as the third zone 19*c*.

The plating film 31 of the plating film-fitted Dumet wire 26 has functions of preventing oxidation and corrosion of the Dumet wire 29 and also preventing impure gas release in the bulb 2 from the Dumet wire 29. Therefore, as is the case with the plating film-fitted Dumet wire 26, the second zone 19*b* consisting primarily of nickel is neither oxidized nor corroded and does not release impure gas into the bulb 2.

As described above, the diameter of the second zone 19*b* is set to be equal to the diameter of the third zone 19*c*, and thus the diameter of the second zone 19*b* is set at 0.5 mm in the lead wire 4. The first zone 19*a* is set to be thinner than the second zone 19*b*. As a detailed example, the diameter of the first zone 19*a* is set at 0.25 to 0.35 mm. An expressed diameter ratio between the first zone 19*a* and the second zone 19*b* (=the diameter of the first zone 19*a*/the diameter of the second zone 19*b*) is set at a range of 0.4 to 0.8.

As a result of setting the first zone 19*a* to be thinner than the second zone 19*b*, upon welding of the coupling section 20*a* between the first zone 19*a* and the second zone 19*b*, a coupling-side end part of the second zone 19*b* of nickel having a lower melting point than the first zone 19*a* of molybdenum is formed into such a shape that surrounds a coupling-side end part of the first zone 19*a*, and is then solidified after cooled. As a result, coupling strength of the coupling section 20*a* is enhanced.

A middle portion of the second zone 19*b* penetrating through the bridge 5 is subjected to crushing. The crushing of the second zone 19*b* is performed in a radial direction of the lead wire 4. The second zone 19*b* has a crushed portion whose diameter is thin in a crushing direction and whose diameter is widened in a direction orthogonal to the crushing direction. As a result, the crushed portion has a more increased surface area than a surface area provided before the crushing. Due to the surface area increase, adhesion of the second zone 19*b* to the bridge 5 improves after the bridge 5 melts and is cooled upon the production. As a result, a degree of the coupling between the bridge 5 and the second zone 19*b* increases, which improves vibration resistance and impact resistance of the incandescent lamp 1.

The production processes of the incandescent lamp 1 will be briefly described. The pinch seal part 3 is initially of the cylindrical shape, which permits the insertion of the assembly illustrated in FIG. 2 in the bulb 2 through the inner circumference side space of the cylinder. Therefore, after the assembly of FIG. 2 is previously produced outside of the bulb 2, a portion of the assembly located above an upper end of the electrode terminal 16 is inserted in the pinch seal part 3 and the bulb 2 from an opening end (a lower end) of the pinch seal part 3.

Next, the pinch seal part 3 is first melted with high heat, and then compressed with the predetermined pinching tool (not illustrated) and sealed. In the aforementioned state, the pair of the lead wires 4 is both held in a linear state, penetrates through the solidified pinch seal part 3, and has the electrode terminals 16, which are formed as the double-lined parts, projected downwardly from a bottom surface of the pinch seal part 3.

Next, each electrode terminal 16 is bent at the upper end and folded back to each side surface of the pinch seal part 3, turning into a state illustrated in FIG. 1. Next, the air in the bulb 2 is exhausted to the outside thereof via the exhaust pipe 8. Next, inactive gas (for example, xenon, krypton, argon, or nitrogen) is supplied into the bulb 2. Finally, the exhaust pipe 8 is closed through melting at the closing part 9. In a manner described above, the inside of the bulb 2 turns into a state in which the inactive gas is sealed.

TABLE 1

| Material | Young's modulus [Gpa] |
|---|---|
| Molybdenum | 324 |
| Nickel | 168 |
| Dumet wire | 143 |

Table 1 above compares Young's moduli between the materials such as molybdenum. The Young's moduli of molybdenum and nickel in Table 1 correspond to Young's moduli of pure molybdenum and nickel. The first zone 19*a* and the second zone 19*b* primarily consist of molybdenum and nickel, respectively, and thus it is possible to assume that the first zone 19*a* and the second zone 19*b* have the Young's moduli of molybdenum and nickel, respectively, illustrated in Table 1.

Selection of the materials in accordance with Table 1 for the first zone 19*a*, the second zone 19*b*, and the third zone 19*c* provides: the Young's modulus of the first zone 19*a*>the Young's modulus of the second zone 19*b*>the Young's modulus of the third zone 19*c*.

The lead wires 4 in the incandescent lamp 1 hold the filament 6 in the first zone 19*a* consisting primarily of molybdenum. Molybdenum has a higher melting point than the Dumet wire. Therefore, it is possible to suppress embrittlement of a holding part of the lead wire 4, as a section holding the filament 6, along with repeated turning-ON and turning-OFF of the incandescent lamp 1, which suppresses disconnection of the aforementioned holding.

The lead wire 4 penetrates through the pinch seal part 3 in the third zone 19*c* formed of the Dumet wire. The Dumet wire has a close thermal expansion rate to a thermal expansion rate of soft glass. Therefore, sealing performance of a part of the pinch seal part 3 through which the lead wire 4 penetrates is favorable.

Due to the presence of the bridge 5, upon vibration and impact occurring in the incandescent lamp 1, the lead wires 4 do not vibrate much in the facing direction of the pair of the lead wires 4 but greatly vibrates in a thickness direction of the bridge 5 orthogonal to the facing direction and the standing direction of the lead wires 4. An amount of the vibration is maximum at the tip parts 14 of the standing portions 11. Upon the vibration and impact occurring in the incandescent lamp 1, mass of the bridge 5 acts as a vibration force or an impact force on the standing portions 11, and thus loads of the lead wires 4 upon the vibration thereof are amplified accordingly.

Note that a difference in thermal expansion rate between nickel and soft glass increases compared to a difference therein between the Dumet wire and soft glass. However, an amount of the increase in the aforementioned difference remains within a permitted range, thus suppressing lack of the bridge 5 upon coupling of the second zones 19*b* in the standing portions 11 of the pair of lead wires 4 to the bridge 5 as a result of solidification of the bridge 5 after melting and cooling thereof at time of the production of the incandescent lamp 1.

Nickel has electric resistivity which is higher than molybdenum and copper but within permitted values, so that presence of the second zones 19*b* in the lead wires 4 does not raise power consumption problem.

The present invention is not limited to the embodiment described above, and includes various modified examples.

For example, the incandescent lamp 1 is loaded in a vehicle but it is possible to load the incandescent lamp of the invention in a movable body other than a vehicle, for example, a ship or an aircraft, or provide the incandescent lamp in a place, other than the movable body, which is subject to vibration and impact.

In the embodiment, the first zone 19*a* and the second zone 19*b* are coupled together at the coupling section 20*a* of the standing portion 11, and the second zone 19*b* and the third zone 19*c* are coupled together at the coupling section 20*b*. Then the coupling section 20*a* is set above the bridge 5 and the coupling section 20*b* is set below the bridge 5 in the standing direction in the incandescent lamp 1. It is also possible in the invention to place the bridge 5 higher than the section illustrated in FIG. 1 to place the coupling section 20*a* lower than the bridge 5 as long as a predetermined length of the second zone is ensured at the standing portion of the lead wire.

In the embodiment, the first zone 19*a* is formed of the material consisting primarily of molybdenum, the second zone 19*b* is formed of the material consisting primarily of nickel, and the third zone 19*c* is formed of the Dumet wire 29 without the plating film 31 or the plating film-fitted Dumet wire 26 in the standing portion 11. On the contrary, if the lead wire of the invention has the first zone 19*a*, the second zone 19*b*, and the third zone 19*c* formed of materials whose Young's moduli decrease in order just mentioned, the first zone 19*a* and the second zone 19*b* may be formed of materials other than materials consisting primarily of molybdenum and nickel, respectively.

The material of the first zone 19*a* may contain a component other than molybdenum as long as molybdenum is a primary component of the aforementioned material. The material of the second zone 19*b* may contain a component other than nickel as long as nickel is a primary component of the aforementioned material.

The crushing of the part of the second zone 19*b* penetrating through the bridge 5 is performed in a given radial direction in the embodiment. The second zone 19*b* is preferably formed in a radial direction corresponding to the thickness direction of the bridge 5 to be widened in the facing direction. In the aforementioned case, the pinching direction of the bridge 5 at the time of production corresponds to a direction in which the second zone 19*b* is formed to be thinner, thus increasing adhesion of the crushed part to the bridge 5.

What is claimed is:

1. An incandescent lamp comprising:

a bulb being made of soft glass;

a sealing part being made of soft glass and sealing the bulb;

a pair of lead wires having standing portions standing in the bulb from the sealing part in a manner such as to face each other, the lead wires penetrating through the sealing part while being firmly fixed to the sealing part to be exposed to an outside of the sealing part;

a filament being arranged between the standing portions of the pair of lead wires, the filament having both end parts held at tip parts of the respective standing portions; and a bridge being made of soft glass and arranged between the standing portions of the pair of lead wires on a side closer to the sealing part than the filament, the bridge having both end parts coupled to the respective standing portions, wherein each of the lead wires is divided into a first zone, a second zone, and a third zone whose Young's moduli decrease in order from a one end side to an another end side where the one end is an end of the lead wire on a tip side of the standing portion and the another end is an end of the lead wire on an exposure side exposed to the outside of the sealing part, the third zone is formed of a Dumet wire or a nickel plating film-fitted Dumet wire, and each lead wire penetrates through the sealing part in the third zone.

2. The incandescent lamp according to claim 1, wherein the first zone is formed of a material consisting primarily of molybdenum.

3. The incandescent lamp according to claim 1, wherein the second zone is formed of a material consisting primarily of nickel, and each lead wire penetrates through the bridge in the second zone.

4. The incandescent lamp according to claim 3, wherein the second zone is subjected to crushing in a radial direction at a part thereof penetrating through the bridge.

* * * * *